US006055683A

United States Patent [19]

Komer

[11] Patent Number: 6,055,683

[45] Date of Patent: May 2, 2000

[54] SWIMMING POOL LANE MARKER FOR THE VISUALLY IMPAIRED

[76] Inventor: John M. Komer, 3224 Modred Cir., NW., Canton, Ohio 44708

[21] Appl. No.: 09/223,530

[22] Filed: Dec. 30, 1998

[51] Int. Cl.[7] ..... E04H 4/00

[52] U.S. Cl. ..... 4/505; 4/496

[58] Field of Search ..... 4/488, 492, 496, 4/505, 506

[56] References Cited

U.S. PATENT DOCUMENTS

| | | | |
|---|---|---|---|
| 1,403,009 | 1/1922 | Carter | 4/492 |
| 3,251,071 | 5/1966 | Wood . | |
| 3,621,496 | 11/1971 | Mc Williams | 4/505 |
| 4,051,562 | 10/1977 | Jakowicki | 4/172 |
| 4,170,044 | 10/1979 | Steimle | 4/488 |
| 4,219,894 | 9/1980 | Jakowicki | 4/488 |
| 4,249,273 | 2/1981 | Jakowicki | 4/494 |
| 4,324,009 | 4/1982 | Hornsby | 4/492 |
| 4,995,123 | 2/1991 | Kern | 4/490 |

FOREIGN PATENT DOCUMENTS

| | | | |
|---|---|---|---|
| 2231477 | 1/1974 | Germany | 4/488 |

*Primary Examiner*—Charles E. Phillips
*Attorney, Agent, or Firm*—Sand & Sebolt

[57] ABSTRACT

A swimming pool lane marker for the visually impaired generally includes a perforated tube that extends the length of a swimming pool. The perforated tube is in fluid communication with a source of compressed gas, such as an air compressor. The air compressor delivers pressurized air to the tube. The pressurized air escapes through the perforations forming a line of bubbles along the swimming lane. The blind swimmer can feel these bubbles and determine his position in the swimming lane. The perforated tube is held under the water by a wire that extends between a pair of frame assemblies that connect the wire to the sidewall of the pool. Pads may be carried on the frame assemblies to protect the swimmer from the sidewall.

18 Claims, 7 Drawing Sheets

SWIMMING POOL LANE MARKER FOR THE VISUALLY IMPAIRED

BACKGROUND OF THE INVENTION

1. Technical Field

The present invention relates generally to lane markers for swimming pools and, more particularly, to a swimming pool lane marker that may be used by a visually impaired swimmer. Specifically, the invention relates to a swimming pool lane marker for the visually impaired that creates a line of bubbles down the middle of the swimming lane that may be felt by the swimmer allowing the swimmer to identify his position in the pool.

2. Background Information

Exercising by swimming laps in a swimming pool is a healthy activity enjoyed by many people. The swimmers typically swim between lane markers that segregate a swimming pool into discreet swimming lanes to prevent the swimmers from running into each other. These lane markers float on the water and are disposed on either side of a line painted on the bottom of the pool. The swimmers use the line and the markers to align themselves while swimming. The alignment process relies largely on visual input.

Blind or visually impaired swimmers cannot rely on such a visual input to align themselves within a swimming lane. Blind swimmers thus find it difficult to easily swim laps without constantly adjusting their position in the swimming lane by physically touching the lane markers on either side of the swimming lane. Although the physical contact with the lane marker allows the swimmer to swim laps, such contact is generally undesirable and is specifically undesirable when the swimmer desires to compete against another swimmer or a clock. The contact breaks the swimmer's rhythm causing him to lose valuable momentum and thus time.

One method of maintaining a blind swimmer's position in a swimming lane is to have a partner walk along side of the swimmer and provide position feedback by touching the swimmer. Although this method is functional along the sides of the pool, the method encounters problems when the blind swimmer must swim in the center of the pool. The method also undesirably requires a partner for each swimmer. It is thus desired in the art to provide a lane marking system that allows a blind swimmer to feel his position in a swimming lane without requiring the swimmer to touch the side lane markers or the bottom of the pool. The system should also function without requiring a partner for each swimmer.

SUMMARY OF THE INVENTION

In view of the foregoing, it is an objective of the present invention to provide a swimming pool lane marker for the visually impaired.

Another objective of the present invention is to provide a swimming pool lane marker for the visually impaired that can be easily installed into and removed from existing swimming pools.

Another objective of the present invention is to provide a swimming pool lane marker for the visually impaired that disperses a line of bubbles along the center of a swimming lane that can be used by a swimmer to feel his way down the swimming lane.

Another objective of the present invention is to provide a swimming pool lane marker that is held below the water surface of the pool and suspended above the bottom wall of the pool.

Another objective of the present invention is to provide a swimming pool lane marker for the visually impaired that can be built into the bottom wall of a swimming pool.

Another objective of the present invention is to provide a swimming pool lane marker for the visually impaired that includes an end-of-lane marker that tells the swimmer when the swimmer is approaching an end of the pool.

Another objective of the present invention is to provide a swimming pool lane marker for the visually impaired that includes a removable pad disposed at each end of the swimming lane.

Another objective of the present invention is to provide a swimming pool lane marker for the visually impaired that connects with the existing hardware or lane markers in existing pools.

A further objective of the present invention is to provide a swimming pool lane marker for the visually impaired that is of simple construction, that achieves the stated objectives in a simple, effective, and inexpensive manner, that solves the problems and that satisfies the needs existing in the art.

These and other objectives and advantages of the present invention are obtained by a lane marker for a swimming pool including a tube having a sidewall defining a passageway and a plurality of perforations that extend through the sidewall; and a supply of gas in fluid communication with the passageway.

Other objectives and advantages of the present invention are obtained by a swimming pool and first lane marker in combination; the swimming pool having a sidewall and a bottom wall defining a cavity having at least one swimming area; the lane marker including a tube extending across a portion of the swimming area; the tube having a sidewall defining a passageway and a plurality of perforations; and a source of gas in fluid communication with the passageway.

BRIEF DESCRIPTION OF THE DRAWINGS

The preferred embodiments of the invention, illustrative of the best modes in which the applicant has contemplated applying the principles of the invention, are set forth in the following description and are shown in the drawings and are particularly and distinctly pointed out and set forth in the appended claims.

Similar numbers refer to similar elements throughout the specification.

DESCRIPTION OF THE PREFERRED EMBODIMENTS

Figure 1:
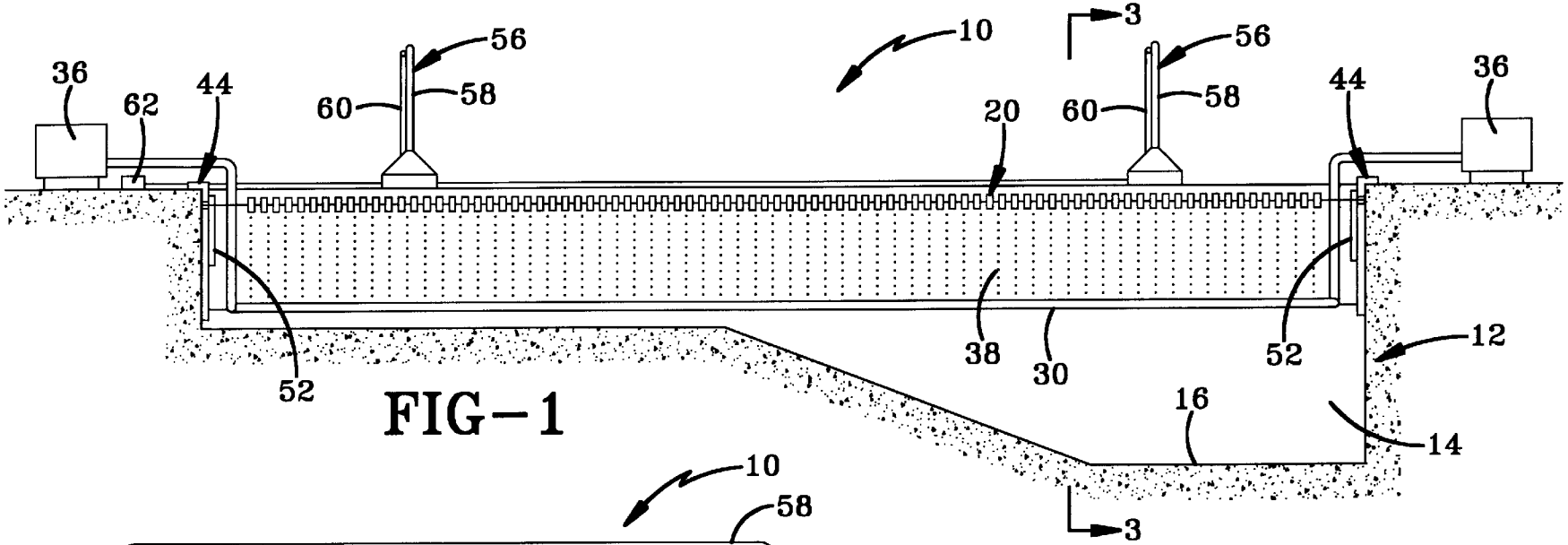
FIG. 1 is a side view of the first embodiment of the lane marker of the present invention installed in a swimming pool.

The first embodiment of the swimming pool lane marker for the visually impaired made in accordance with the concepts of the present invention is indicated generally by the numeral 10 in the accompanying drawings. Lane marker 10 is used in a typical swimming pool 12 that includes a sidewall 14 and a bottom wall 16. Sidewall 14 and bottom wall 16 cooperate to define a cavity that is substantially filled with water to define a swimming area. In typical arrangements, lane marker 10 of the present invention is disposed across a longitudinal expanse of swimming pool 12 as depicted in the drawings. It is understood that lane marker 10 may be disposed in other configurations with respect to pool 12 and that the swimming area of pool 12 does not have to be substantially rectangular as shown in the drawings.

In the past, swimming lanes 18 were defined by a pair of floating lane markers 20 or one floating lane marker 20 and a portion of sidewall 14 of pool 12. Floating lane markers 20 generally include a longitudinal cable 22 that carries a plurality of individual floats 24. Cable 22 is connected to a lane marker attachment post 26 that is mounted on sidewall 14 of swimming pool 12. Lane markers 20 may be selectively disconnected from posts 26 and removed from pool 12 by winding them on a large barrel. Such removal allows pool 12 to be selectively configured for lap swimming. As shown in the drawings, floating lane markers 20 float at the water surface 28.

Figure 2:
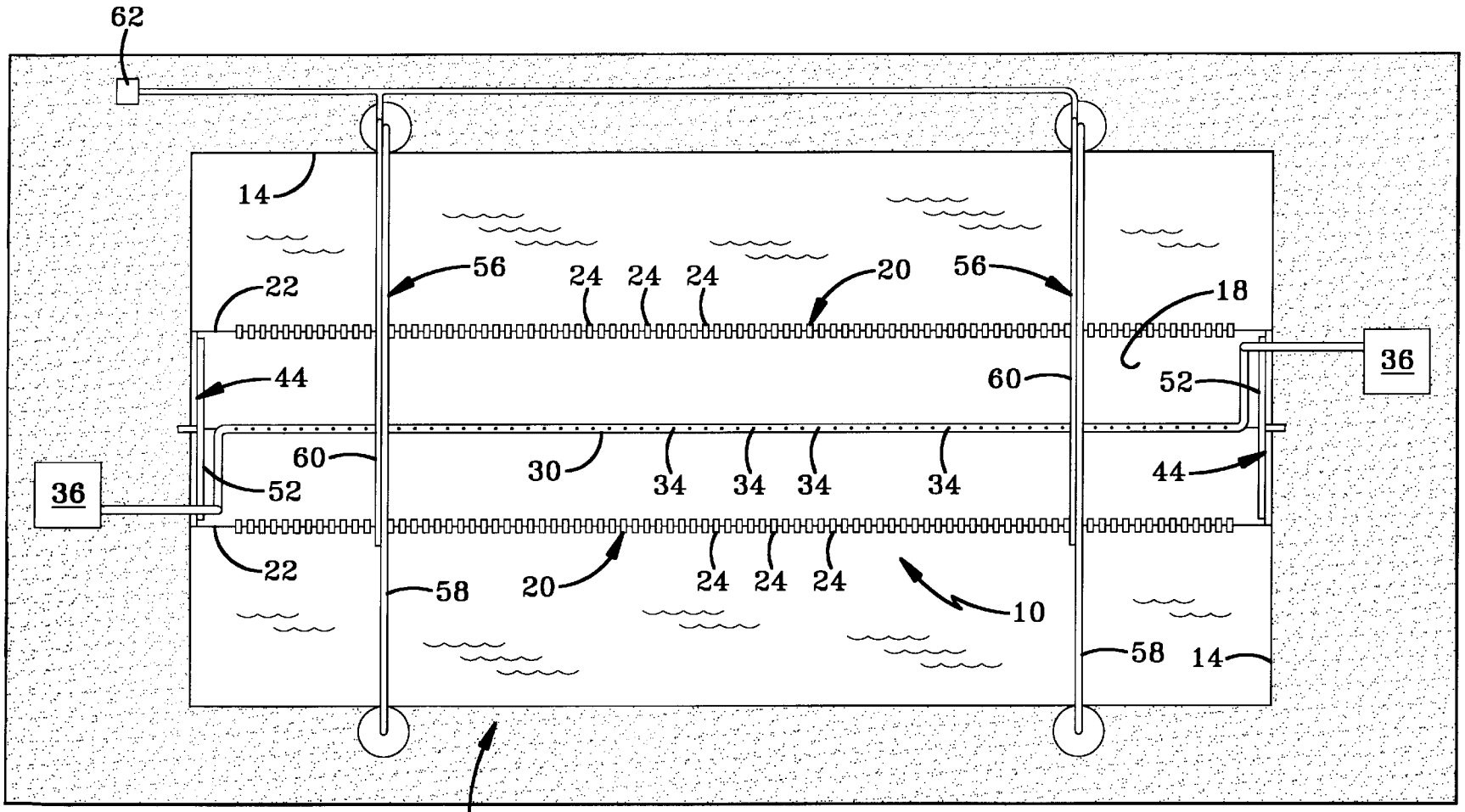
FIG. 2 is a top plan view of the swimming pool of FIG. 1.
Figure 4:
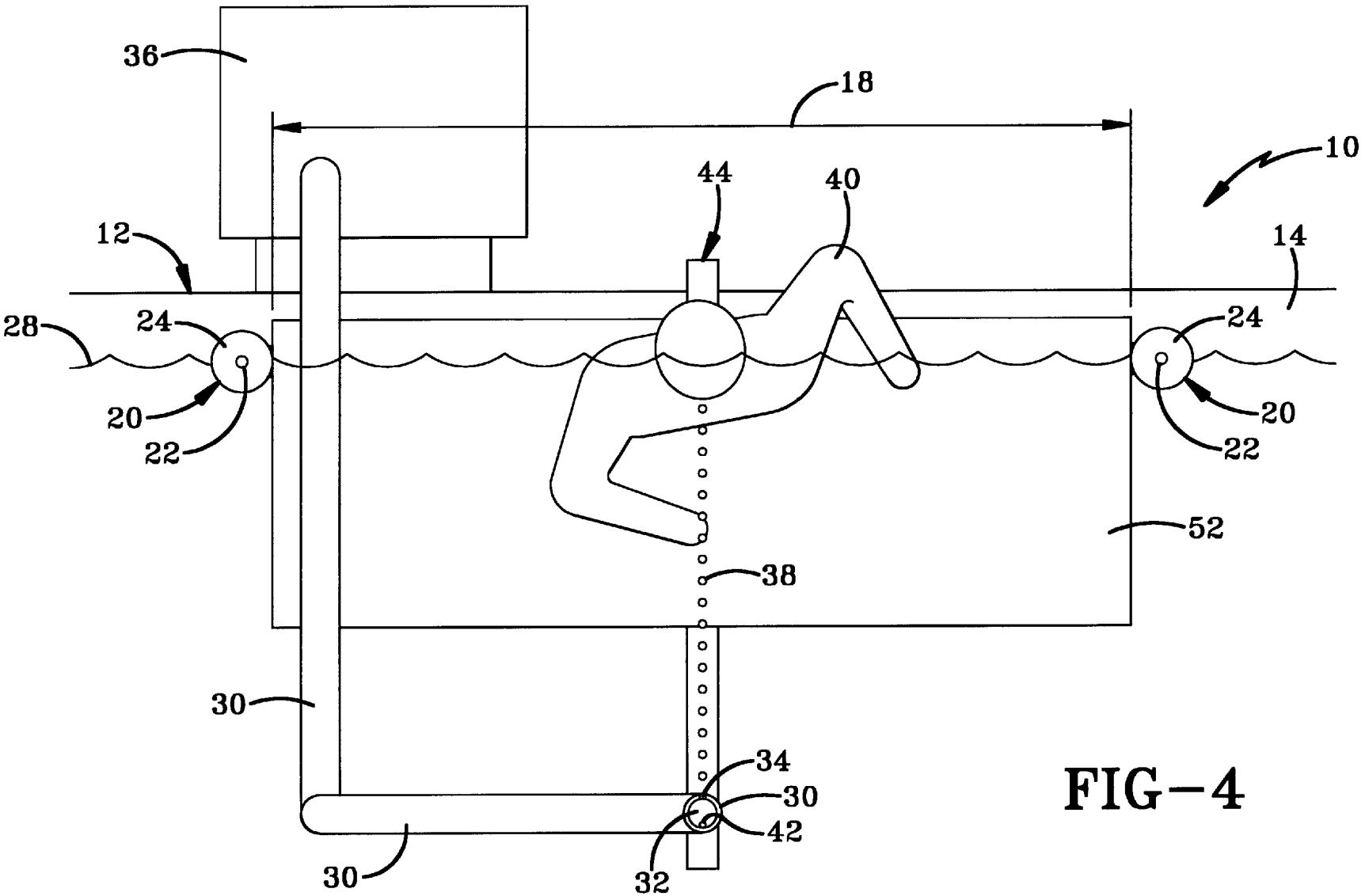
FIG. 4 is an end view showing a swimmer using the first embodiment of the lane marker.

First embodiment of lane marker 10 generally includes a tube 30 having a sidewall that defines a passageway 32 and a plurality of perforations 34. Tube 30 extends longitudinally at approximately the center of swimming lane 18 substantially centered between floating lane markers 20. Tube 30 may be fabricated from a generally lightweight plastic or rubber but also may be fabricated from other suitable materials that are known in the art. Passageway 32 is in fluid communication with a source of gas 36 that provides gas to passageway 32 where it exits passageway 32 through perforations 34 to form bubbles 38. Bubbles 38 are felt by a swimmer 40 so that swimmer 40 may determine his position with respect to lane markers 20. Source of gas 36 is preferably an air compressor or air blower that delivers air to tube 30 in a volume sufficient to fill the entire length of tube 30 with air causing bubbles 38 to rise from tube 30 along the entire length of pool 12. When the length of pool 12 or the diameter of tube 30 exceeds the capacity of a single air compressor 36 a second air compressor 36 (or additional sources 36), may be provided in fluid communication with passageway 32 at the other end of pool 12 as depicted in FIGS. 1 and 2. Each source 36 may be provided with a check valve (not shown) that prevents water from damaging source 36.

As described above, tube 30 may be fabricated from a material that typically floats. In addition, tube 30 is filled with a gas, such as air, that is lighter than water. As such, tube 30 must be anchored below water surface 28 or it would float and interfere with swimmer 40. In the first embodiment of lane marker 10, a wire 42 extends through passageway 32 and holds tube 30 suspended above bottom wall 16 but below water surface 28 so as to not interfere with swimmer 40. Wire 42 may also be clipped to the outside of tube 30 with a suitable clip that wraps about at least a portion of tube 30. Wire 42 extends between two portions of sidewall 14 of pool 12 or, as shown in the drawings, extends between a pair of frame assemblies that are mounted on sidewall 14 of swimming pool 12. Other suitable weights may also be used to hold tube 30 below the surface.

Each frame assembly 44 includes a hook 46 that fits over the edge of pool 12 and a cross bar 48 that extends between floating lane markers 20. Each frame assembly 44 further includes a wire attachment post 50 that positions wire 42 far enough below water surface 28 to prevent tube 30 from interfering with swimmer 40. Each frame assembly 44 may be attached to swimming pool 12 by appropriate connectors that may be secured to sidewall 14. One manner of making such a connection is by connecting the ends of cross bar 48 to lane marker attachment posts 26. Another manner of forming the connection is to connect the ends of cross bar 48 to cable 22 of floating lane markers 20.

In addition to supporting wire 42 that maintains the position of tube 30, each frame assembly 44 may also carry a pad 52 that protects swimmer 40 from accidentally injuring himself on sidewall 14 of pool 12. Each pad 52 may be removably mounted on frame assembly 44 by connectors such as hook and loop fasteners 54. Pad 52 may have floatation capabilities so that it may be used in a life saving situation.

Figure 3:
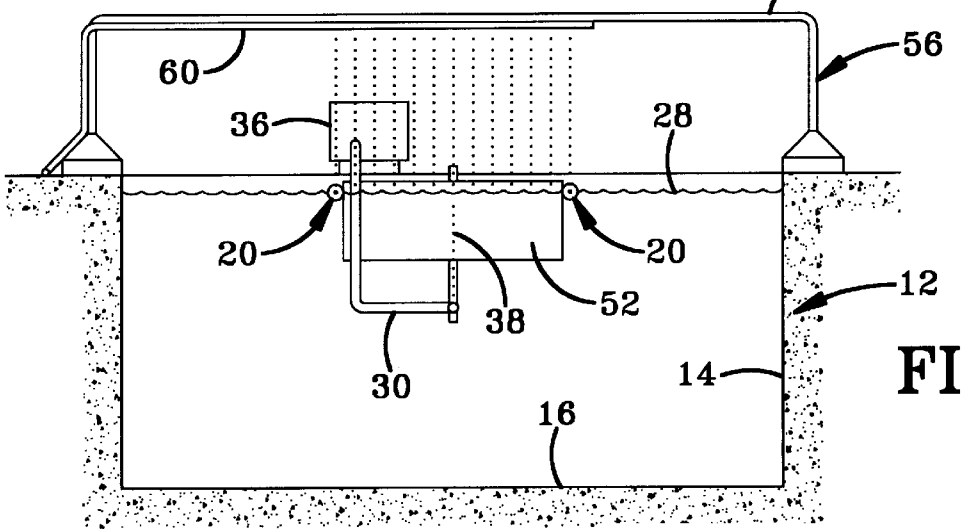
FIG. 3 is a sectional view taken along line 3—3 of FIG. 1.

Another feature of lane marker 10 is an end-of-lane marker 56 that is disposed above each end of swimming lane 18. In the first embodiment of lane marker 10, end-of-lane marker 56 includes a support 58 that extends over swimming lane 18 and carries a perforated water pipe 60. Perforated water pipe 60 is in fluid communication with a source of water 62 to create a curtain of water droplets at the end of swimming lane 18 as shown in FIG. 3. The curtain of water droplets tells swimmer 40 that sidewall 14 of swimming pool 12 is near and swimmer 40 can anticipate contact with pad 52.

Figure 5:
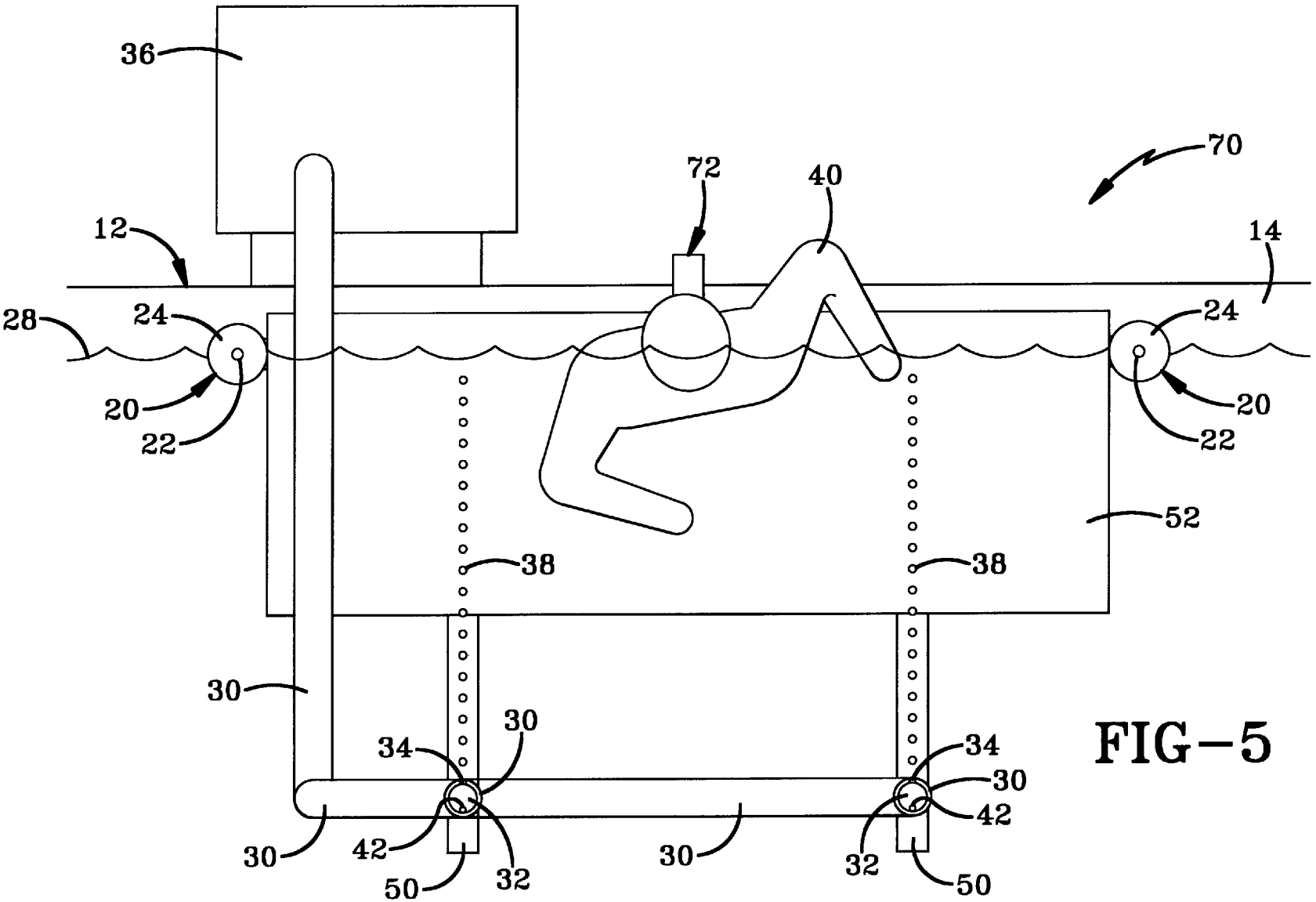
FIG. 5 is an end view similar to FIG. 4 showing a swimmer using a second embodiment of the present invention.
Figure 7:
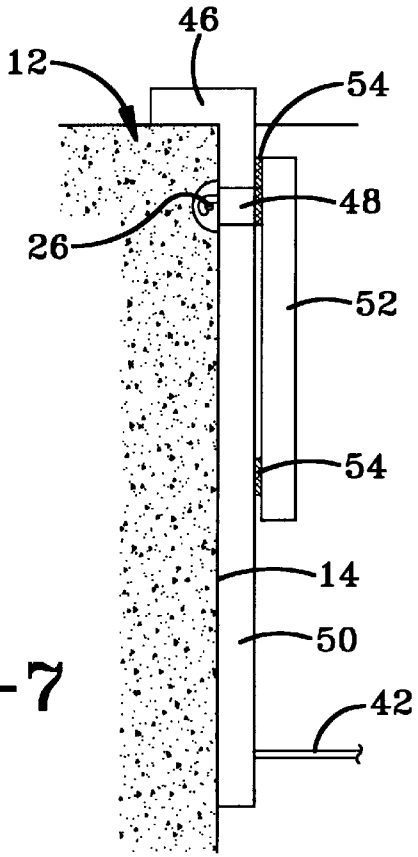
FIG. 7 is a side view of the pad and frame of FIG. 6.
Figure 6:
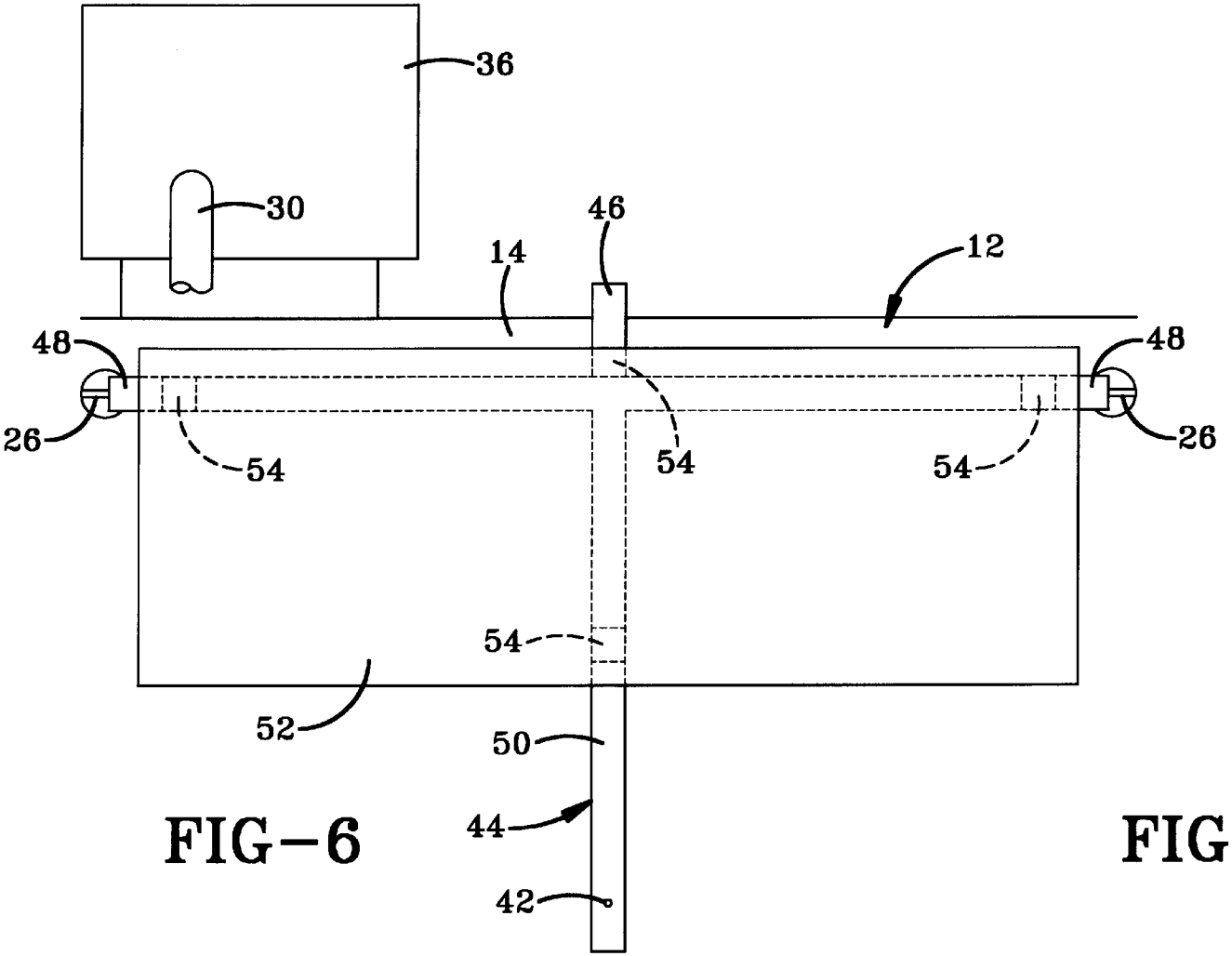
FIG. 6 is an end view of the pad and frame of the present invention.

A second embodiment of the swimming pool lane marker for the visually impaired made in accordance with the concepts of the present invention is indicated generally by the numeral 70 in FIG. 5. Lane marker 70 is substantially similar to lane marker 10 except that lane marker 70 includes a pair of substantially parallel tubes 30. Each tube 30 is in fluid communication with gas source 36 to form a pair of spaced curtains of bubbles 38. Swimmer 40 thus feels bubbles 38 when he starts to move out of the ideal swimming lane. The frame assembly 72 that supports tubes 30 of lane marker 70 includes a pair of wire attachment posts 50 extending down from cross bar 48. Lane marker 70 is otherwise substantially similar to lane marker 10.

Figure 8:
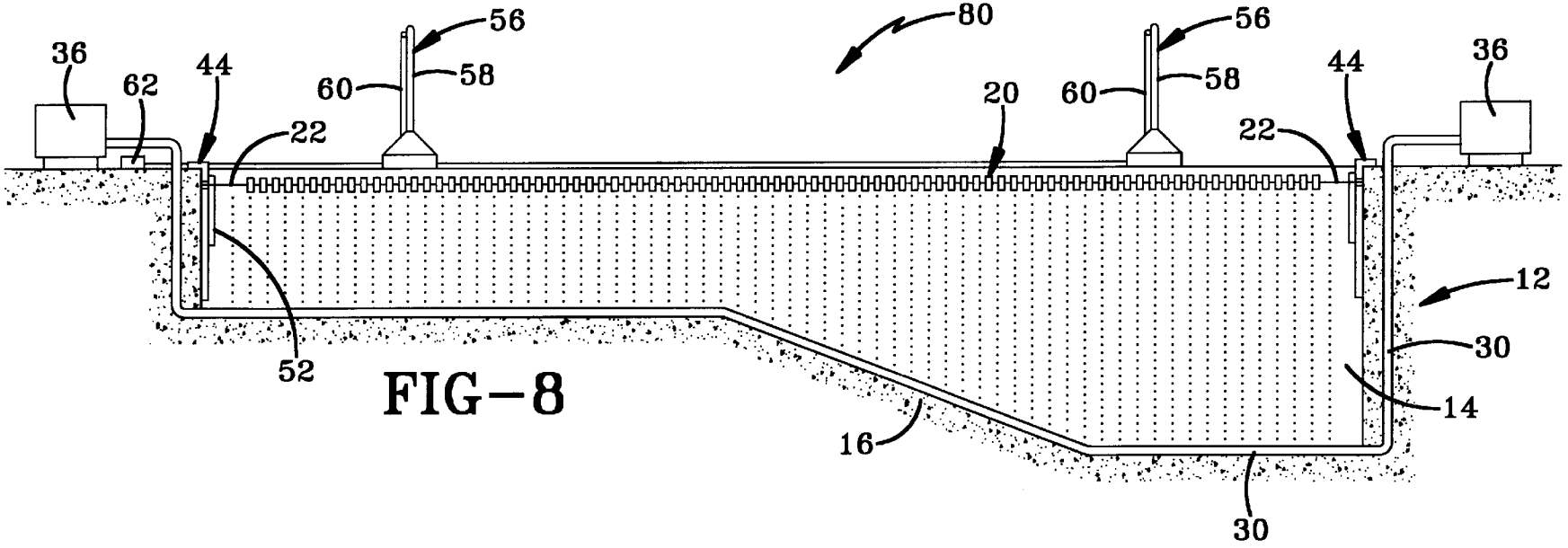
FIG. 8 is a side view similar to FIG. 1 showing a third embodiment of the present invention.

A third embodiment of the swimming pool lane marker of the present invention is indicated generally by the numeral 80 in FIG. 8. In this embodiment, tube 30 is integrally formed with bottom wall 16 of swimming pool 12 such that perforations 34 are formed in bottom wall 16. A pair of tubes 30 may also be used with this embodiment. In this embodiment, wire 42 is not required to hold tube 30 below water surface 28. Frame assemblies 44 still may be used to carry pads 52.

Figure 9:
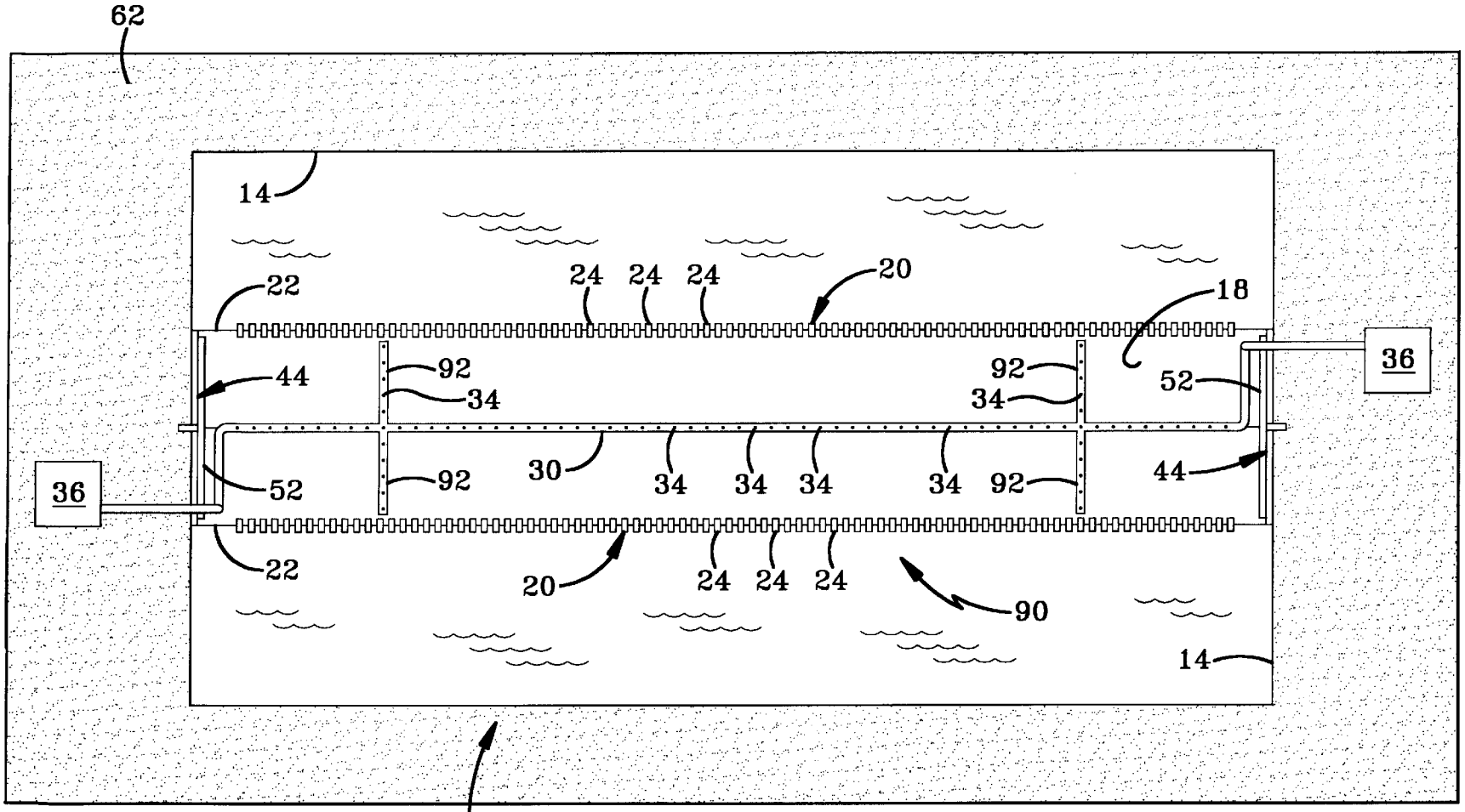
FIG. 9 is a top plan view similar to FIG. 2 showing a fourth embodiment of the present invention.

A fourth embodiment of the lane marker is indicated generally by the numeral 90 in FIG. 9. Lane marker 90 includes a pair of tube branches 92 that extend substantially perpendicularly from tube 30 adjacent the end of swimming lane 18. Each branch 92 includes perforations 34 that allow bubbles to escape from branches 92. Branches 92 thus form curtains of bubbles adjacent the ends of swimming lane 18 to warn swimmer 40 that sidewall 14 of swimming pool 12 is near. Tube 30 and branches 92 may be integrally formed in bottom wall 16 or may be supported on appropriate wires 42 as described above.

Accordingly, the improved swimming pool lane marker for the visually impaired is simplified, provides an effective, safe, inexpensive, and efficient device that achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the swimming pool lane marker for the visually impaired is constructed and used, the characteristics of the construction, and the advantageous new and useful results obtained; the new and useful structures, devices, elements, arrangements, parts, and combinations are set forth in the appended claims.

What is claimed is:

1. A lane marker for a swimming pool comprising:

a tube having a sidewall defining a passageway and plurality of perforations that each extend through the sidewall;

a supply of gas in fluid communication with the passageway; and a wire disposed in the passageway.

2. The lane marker of claim 1, wherein the supply of gas is an air blower.

3. The lane marker of claim 1, further comprising a pair of frame assemblies, the wire connected to each of the frame assembly.

4. The lane marker of claim 3, further comprising a pad mounted on each of the frame assemblies.

5. In combination, a swimming pool having a swimming lane and a first lane marker disposed in the swimming lane; the first lane marker allowing a blind swimmer to guide himself in the swimming lane;

the swimming pool having a sidewall and a bottom wall defining a cavity having at least one swimming area;

water disposed in the cavity of the swimming pool;

the lane marker including a tube extending across a portion of the swimming area; the tube having a sidewall defining a passageway and a plurality of perforations; the tube being suspended in the water above the bottom wall of the swimming pool and the tube being free of connections with the bottom wall of the swimming pool; and a source of gas in fluid communication with the passageway; the gas being forced out of the perforations into the water to create a line of bubbles that are adapted to guide the blind swimmer along the swimming lane.

6. The combination of claim 5, further comprising an end-of-lane marker including a perforated gas pipe and a source of gas in fluid communication with the gas pipe; the gas pipe disposed substantially perpendicular to the lane marker.

7. The combination of claim 5, wherein the sidewall of the swimming pool includes a pair of spaced opposing first walls and a pair of spaced opposing second walls; the lane marker extending between two of said walls.

8. The combination of claim 7, wherein the passageway is disposed above the bottom wall.

9. The combination of claim 8, further comprising an anchoring wire connected to the tube.

10. The combination of claim 5, wherein the source of gas is an air blower.

11. The combination of claim 10, further comprising a second air blower in fluid communication with the passageway.

12. The combination of claim 5, further comprising a second lane marker disposed substantially parallel to the first lane marker; the second lane marker including a tube extending across a portion of the swimming area; the tube having a sidewall defining a passageway and a plurality of perforations; the tube of the second lane market being in fluid communication with the source of gas.

13. In combination, a swimming pool and a first lane marker;

the swimming pool having a sidewall and a bottom wall defining a cavity having at least one swimming area;

the lane marker including a tube extending across a portion of the swimming area; the tube having a sidewall defining a passageway and a plurality of perforations;

a source of gas in fluid communication with the passageway; and first and second frame assemblies mounted on the sidewall of the swimming pool.

14. The combination of claim 13, further comprising an anchoring wire disposed in the tube; the anchoring wire extending between the frame assemblies.

15. The combination of claim 13, further comprising a pad mounted on each of the frame assemblies.

16. The combination of claim 13, wherein the sidewall of the swimming pool includes lane marker attachment posts, each of the frame assemblies connected to at least one of the lane marker attachment posts.

17. The combination of claim 13, further comprising a pair of floating lane markers, the tube disposed intermediate the floating lane markers.

18. In combination, a swimming pool and a first lane marker;

the swimming pool having a sidewall and a bottom wall defining a cavity having at least one swimming area;

the lane marker including a tube extending across a portion of the swimming area; the tube having a sidewall defining a passageway and a plurality of perforations;

a source of gas in fluid communication with the passageway; and an end-of-lane marker including a perforated water pipe disposed above the lane marker and a source of water in fluid communication with the water pipe.

* * * * *